US008881834B2

(12) United States Patent
Lauderdale

(10) Patent No.: US 8,881,834 B2
(45) Date of Patent: Nov. 11, 2014

(54) ADJUSTABLE PRESSURE HYDROSTATIC SETTING MODULE

(75) Inventor: Donald P. Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 406 days.

(21) Appl. No.: 13/461,073

(22) Filed: May 1, 2012

(65) Prior Publication Data

US 2013/0292137 A1 Nov. 7, 2013

(51) Int. Cl.
*E21B 23/04* (2006.01)
*E21B 23/06* (2006.01)

(52) U.S. Cl.
USPC ..... 166/383; 166/120; 166/122

(58) Field of Classification Search
USPC ..... 166/386, 387, 120, 383, 122
See application file for complete search history.

(56) References Cited

U.S. PATENT DOCUMENTS

| | | | | |
|---|---|---|---|---|
| 3,139,140 | A * | 6/1964 | Brown | 166/120 |
| 4,665,992 | A * | 5/1987 | Franc | 166/387 |
| 5,893,413 | A | 4/1999 | Lembcke et al. | |
| 6,202,747 | B1 | 3/2001 | Lacy et al. | |
| 2001/0030049 | A1 | 10/2001 | Patel | |
| 2004/0069496 | A1 | 4/2004 | Hosie et al. | |
| 2009/0321081 | A1 | 12/2009 | Schramm et al. | |

* cited by examiner

*Primary Examiner* — Cathleen Hutchins
(74) *Attorney, Agent, or Firm* — Shawn Hunter

(57) ABSTRACT

An adjustable pressure hydrostatic setting module includes a collapsible pressure chamber and a setting chamber. The pressure chamber is precharged at a fluid pressure that is greater than atmospheric pressure and greater than the fluid pressure within the setting chamber. In a described embodiment, the setting module also includes a frangible rupture member that closes off the setting chamber from annulus pressure. A regulator governs the transfer of fluid pressure from the collapsible chamber to the setting chamber.

19 Claims, 5 Drawing Sheets

ADJUSTABLE PRESSURE HYDROSTATIC SETTING MODULE

BACKGROUND OF THE INVENTION

1. Field of the Invention

The invention relates generally to downhole tools which are actuated using hydrostatic pressure.

2. Description of the Related Art

A number of downhole tools rely upon total hydrostatic pressure in order to be actuated. Wellbore hydrostatic pressure and applied fluid pressure are used to rupture a frangible member and/or act upon a piston. The wellbore hydrostatic pressure is the pressure exerted by the weight of fluid above a point of interest in the wellbore. Applied fluid pressure is the pressure that artificially applied at surface by a fluid pump. Total pressure is the sum of both wellbore hydrostatic pressure and applied pressure. Hydrostatic setting tools are used to set or actuate a neighboring downhole tool, such as a packer or lock. A commercially available tool of this type is the Striker™ setting tool that is available commercially from Baker Hughes Incorporated of Houston, Tex.

Increasing depth within the wellbore increases the hydrostatic wellbore pressure and, thus, the total pressure differential across a frangible member, such as a rupture disc, also increases. Thus, a setting tool that is useful at a shallower depth may not be useable at a greater depth. As a result, custom setting tool designs having stronger frangible members have to be developed to be used at greater wellbore depths.

SUMMARY OF THE INVENTION

The invention provides methods and devices for actuating a well tool using a hydrostatic setting tool that contains an adjustable pressure hydrostatic setting module. An exemplary setting tool is described that can set an adjacent well tool by axially moving an outer housing with respect to an inner mandrel.

An exemplary adjustable pressure hydrostatic setting module is described that includes a collapsible pressure chamber and a setting chamber. The pressure chamber is precharged at a fluid pressure that is greater than atmospheric pressure and greater than the fluid pressure within the setting chamber. In a described embodiment, the setting module also includes a frangible rupture member that closes off the setting chamber from annulus pressure.

A regulator governs the transfer of fluid pressure from the collapsible chamber to the setting chamber. In a described embodiment, the regulator includes a check valve that permits one-way fluid flow from the collapsible chamber to the setting chamber. The check valve is biased toward a closed position. A piston is associated with the check valve such that movement of the piston will open the check valve. In a described embodiment, annulus pressure acts upon the piston.

In operation, the regulator flows fluid from the collapsible pressure chamber to the setting chamber as the setting tool is lowered toward a predetermined setting depth within a wellbore. Increased hydrostatic pressure at increased wellbore depths will open the regulator check valve and permit fluid flow from the collapsible chamber to the setting chamber. In an embodiment, the collapsible pressure chamber is precharged via a fluid fill port to a fluid pressure level that is greater than that of the setting chamber. The precharge pressure of the collapsible pressure chamber is calculated so that, as pressure is transmitted from the collapsible chamber to the setting chamber, the resulting fluid pressures within both chambers at or near the setting depth will be substantially equal.

The devices and methods of the present invention prevent the need to have custom designs with very strong rupture discs and allows setting tool designs to be used at various well depths without the need to replace the rupture disc with a stronger one. The devices and method of the present invention are applicable to a variety of tools and devices and, in particular, a number of tools and devices that are used in a wellbore environment.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
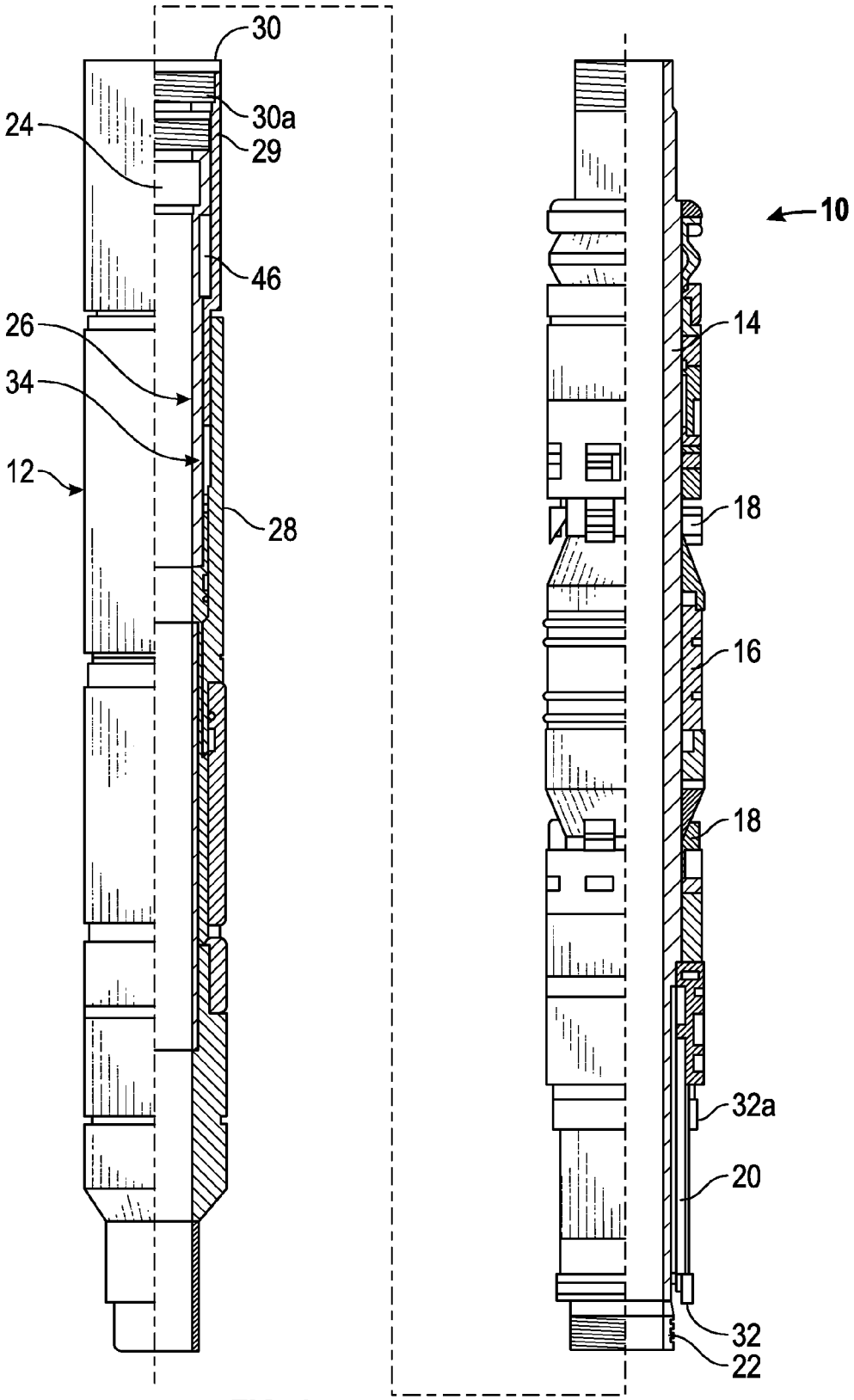
FIG. 1 is a side, cross-sectional view of an exemplary packer device and hydrostatic setting tool constructed in accordance with the present invention.

FIG. 1 illustrates an exemplary packer device 10 and affixed packer setting tool 12. As the structure and operation of packer devices are generally well-known and will not be described in detail here. The packer device may be a Premier™ production packer which is available commercially from Baker Hughes Incorporated of Houston, Tex. It is noted, however, the packer device 10 is a compression-set packer which includes a central mandrel 14 with a radially surrounding packer element 16 and slip anchors 18. A setting sleeve 20 also radially surrounds the mandrel 14 and is axially moveable with respect to the mandrel 14. When the setting sleeve 20 is moved axially upon the mandrel 14, the packer element 16 and slip anchors 18 are set by axial compression, as is known. The packer device 10 includes a threaded portion 22 for threaded interconnection with a complimentary threaded portion 24 on the setting tool 12. It is noted that, while a compression-set packer device 10 is described here, other types of tools that are compression set or actuated might be operated by the setting tool 12 instead.

The setting tool 12 includes an inner setting tool mandrel 26 and radially-surrounding outer housing portions 28, 29 which are axially moveable with respect to the inner mandrel 26. Except where otherwise described herein with respect to the hydrostatic setting module and pressure regulator features which will be described, the setting tool 12 may be constructed and operate in the manner of a Striker™ setting tool which is available commercially from Baker Hughes Incorporated. The outer housing 28 presents an axial end 30 that abuts setting shoulder 32*a* when the setting tool 12 is affixed to the packer device 10. Setting piston 32 on the packer device 10 is used to set the packer device 10 in a conventional setting mode without the hydrostatic setting tool 12. When the packer device 10 and the setting tool 12 are assembled, setting piston 32 will seal on and slide between the outer diameter of the mandrel 14 and the inner diameter of the outer housing portion 29.

Figure 2:
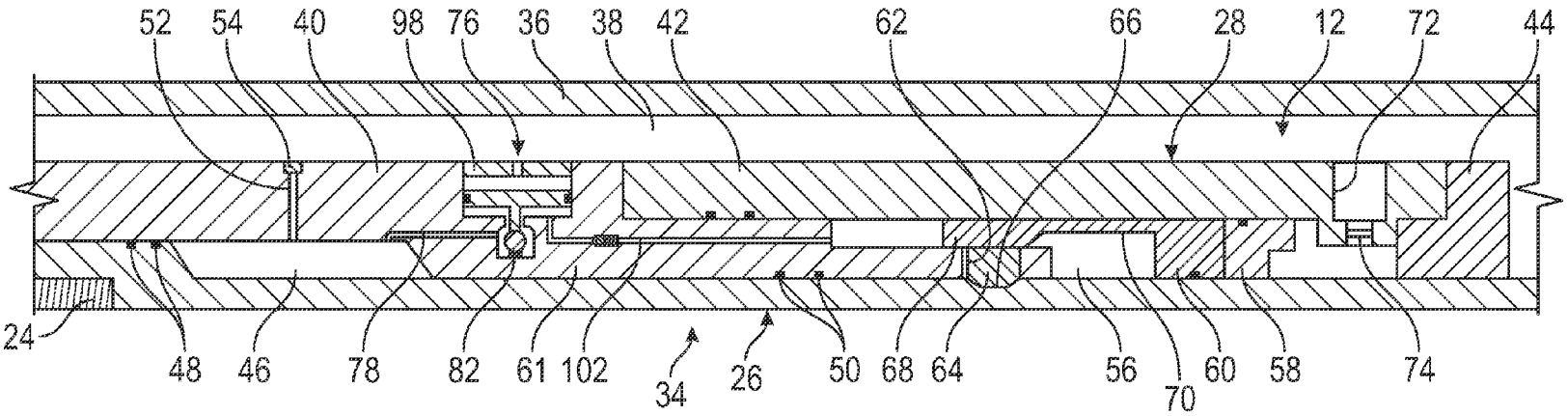
FIG. 2 is an enlarged side, one-quarter cross-sectional view of portions of an exemplary adjustable pressure hydrostatic setting module with pressure regulator that is used within the setting tool.
Figure 3:
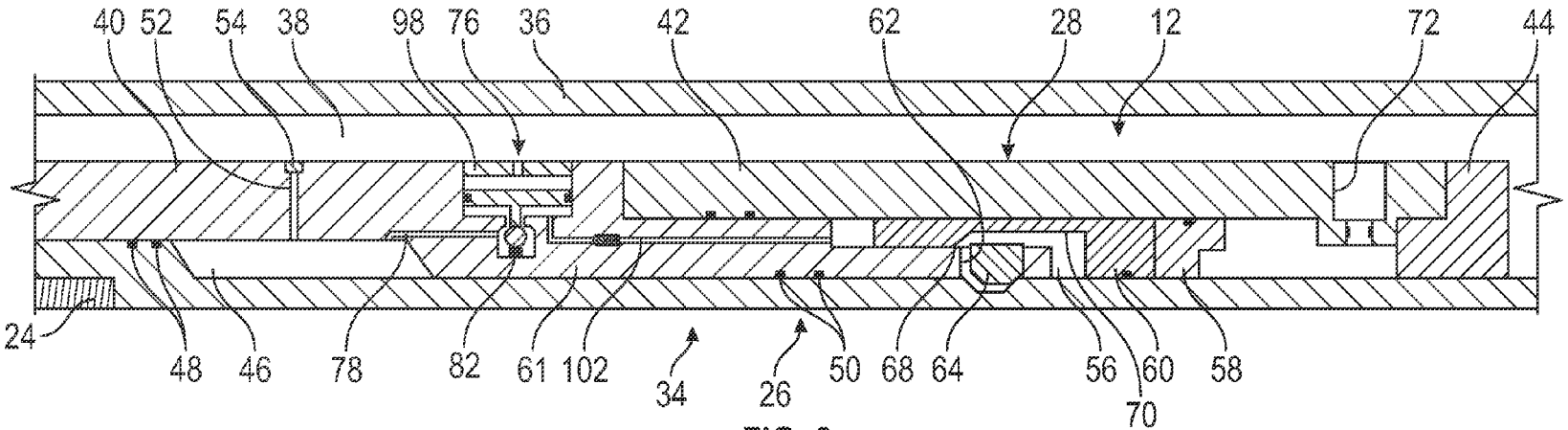
FIG. 3 is an enlarged side, one-quarter cross-sectional view of portions of the adjustable pressure hydrostatic setting module now in a partially actuated position.
Figure 4:
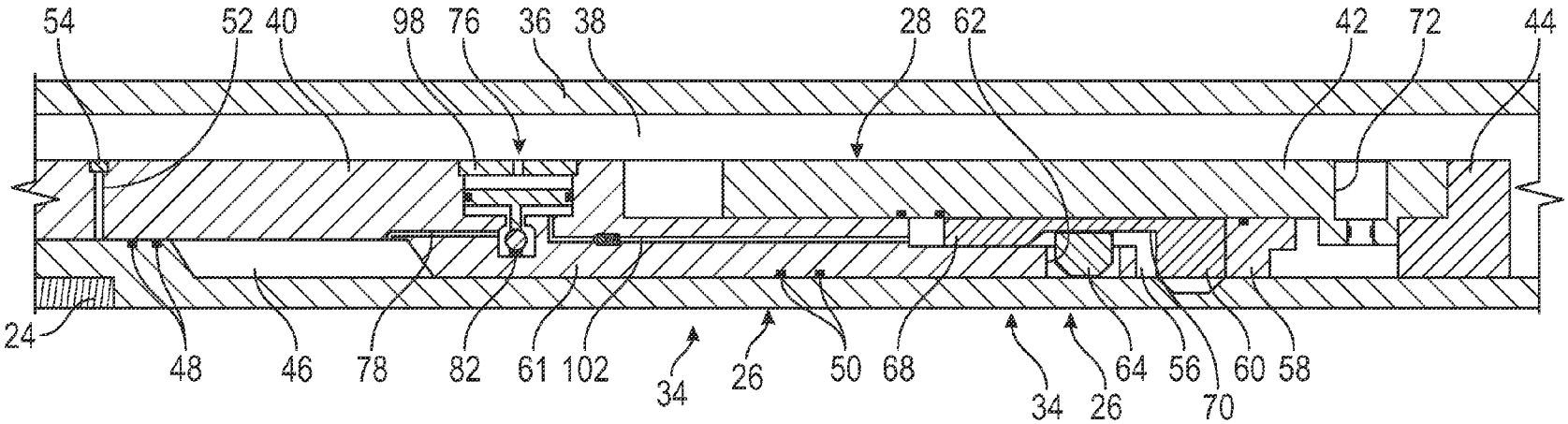
FIG. 4 is an enlarged side, one-quarter cross-sectional view of portions of the adjustable pressure hydrostatic setting module now in a fully actuated position.

The setting tool 12 includes an adjustable pressure hydrostatic setting module, which is generally indicated at 34 in FIG. 1. The setting module 34 operates to move the outer housing 28 axially with respect to the inner mandrel 26, thereby setting the affixed packer device 10. Structure and operation of the setting module 34 is better appreciated with reference to FIGS. 2-4. In FIGS. 2-4, the setting module 34 of the setting tool 12 is shown proximate a well casing 36 and an annulus 38 is defined between the tool 12 and the well casing 36.

In the setting module 34 depicted in FIGS. 2-4, the outer housing 28 includes upper and lower housing sections 40, 42. An end ring 44 is located below the lower housing section 42. A collapsible pressure chamber 46 is defined radially between the inner mandrel 26 and the upper housing section 40. In the depicted embodiment, the collapsible pressure chamber 46 is bounded by elastomeric fluid seals 48 and 50. A fluid fill port 52 is preferably disposed through the upper housing section 40 and is closed off by a removable plug 54. The fluid fill port 52 allows fluid to be flowed into the collapsible pressure chamber 46 in order to pressurize it to a desired fluid pressure level.

A setting chamber 56 is defined radially between the inner mandrel 26 and the lower housing section 42. The setting chamber 56 is bounded at its upper end by the upper housing section 40 and at its lower end by the end ring 44. A lock piston 58 and lock ring 60 are moveably disposed within the setting chamber 56.

The upper housing section 40 preferably features an inwardly-projecting portion 61. The lower end of the inwardly-projecting portion 61 has a window 62 disposed through it which loosely retains a locking dog 64. The locking dog 64 is also disposed within an exterior annular groove 66 that is formed within the inner mandrel 26. The locking dog 64 is initially retained within the groove 66 by an inwardly-projecting portion 68 of the lock ring 60. The lock ring 60 also includes a radially enlarged recess 70 that is adjacent the inwardly-projecting portion 68.

A lateral fluid flow port 72 is formed through the lower housing section 42 to allow fluid communication between the setting chamber 56 and the annulus 38. The port 72 is initially closed off by a frangible rupture disc 74.

A regulator, generally shown at 76, is incorporated into the setting module 34 and governs flow of fluid pressure from the collapsible chamber 46 to the setting chamber 56. Portions of the regulator 76 are shown in greater detail in FIGS. 5 and 6. In the depicted embodiment, the regulator 76 includes a fluid inflow conduit 78 that extends from the collapsible chamber 46 to a check valve chamber 80. A check valve member 82 is located within the check valve chamber 80 and is biased to a closed position against valve seat 84 by spring 86. It is noted that the check valve member 82, valve seat 84 and spring 86 collectively provide a valve assembly that opens to flow fluid from the collapsible pressure chamber 46 to the setting chamber 56 as pressure surrounding the setting tool 12 is increased.

A piston chamber 88 is located adjacent the check valve chamber 80. A fluid passage 90 extends between the piston chamber 88 and the check valve chamber 80. A piston member 92 is moveably disposed within the piston chamber 88. The piston member 92 preferably has an annular fluid seal 94 that creates a fluid seal between the piston member 92 and the piston chamber 88. A stem 96 extends from the piston member 92 through the fluid passage 90 and into contact with the check valve member 82. The piston chamber 88 is preferably closed off by a plug 98 which is threaded into the upper housing section 40. A fluid flow port 100 is disposed through the plug 98 so that the piston member 92 is exposed to hydrostatic fluid pressure from the annulus 38. A fluid outflow conduit 102 extends between the piston chamber 88 and the setting chamber 56. A one-way check valve 104 is integrated into the fluid outflow conduit 102 to ensure that fluid can only flow is from the piston chamber 88 to the setting chamber 56 and not in reverse.

Figure 5:
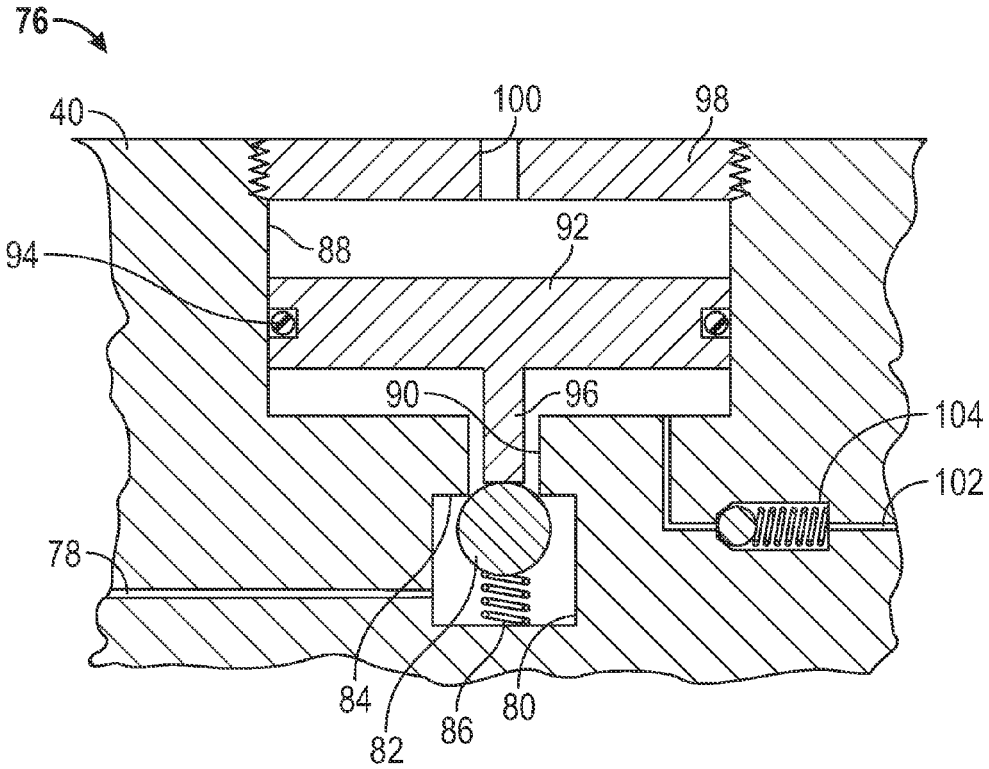
FIG. 5 is a further enlarged detail of portions of an exemplary pressure regulator used within the adjustable pressure hydrostatic setting module.

In operation, the regulator 76 functions to flow fluid from the collapsible pressure chamber 46 to the setting chamber 56 as pressure surrounding the setting tool 12 is increased when it moves deeper into a wellbore. In a preferred embodiment, the collapsible chamber 46 is precharged before use in the wellbore to a desired amount of pressure above atmospheric pressure. The precharge pressure within the collapsible chamber 46 is also above the pressure within the setting chamber 56. When the setting tool 12 is at or near the wellbore opening, where hydrostatic pressure within the annulus 38 is not great, the check valve member 82 remains biased to its closed position, as shown in FIG. 5. As the setting tool 12 is moved deeper within the wellbore, pressure within the annulus 38 will increase. Increased fluid pressure within the annulus 38 is communicated through the port 100 to the piston member 92 and urges the piston member 92 radially inwardly, as indicated by the arrows 106 in FIG. 6. As the piston member 92 moves radially inwardly, the stem 96 urges the valve member 82 off the valve seat 84, compressing the spring 86.

Figure 6:
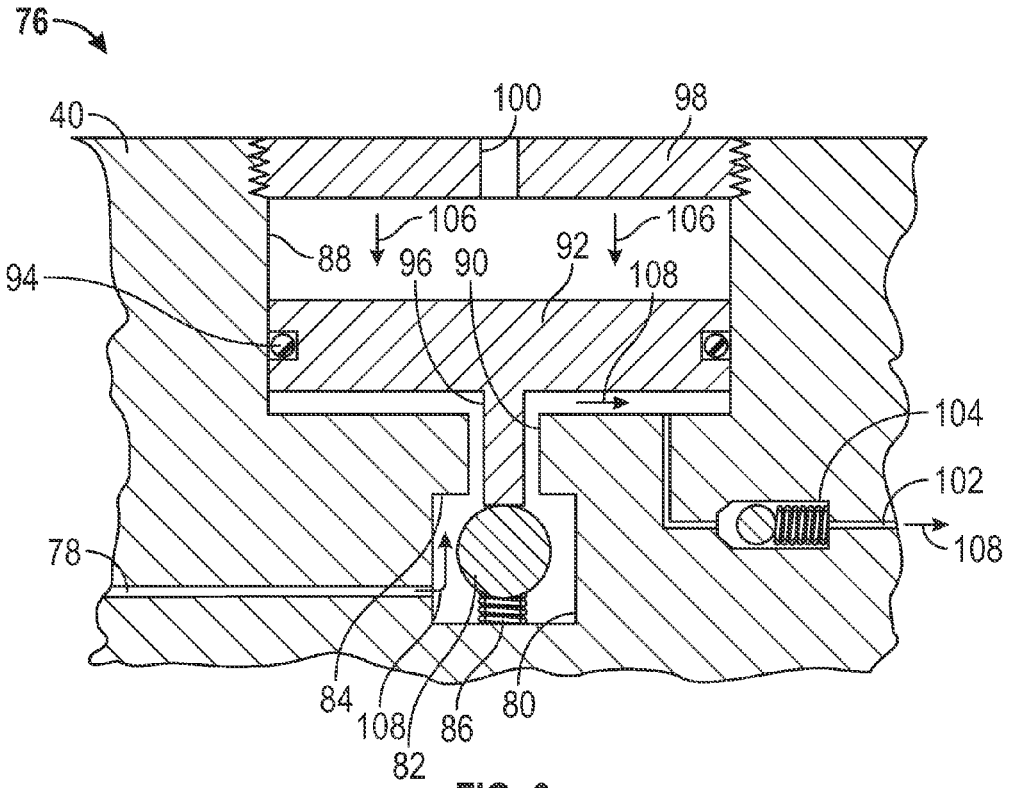
FIG. 6 is a detail view of the pressure regulator of FIG. 5, now in a position that allows fluid flow between chambers in the setting module.

As illustrated by the arrows 108 in FIG. 6, fluid can now flow from the collapsible pressure chamber 46 to the setting chamber 56. Pressurized fluid from the collapsible pressure chamber 46 is communicated along the fluid inflow conduit 78 into the check valve chamber 80 and through the now open fluid passage 90 to the piston chamber 88. The pressurized fluid will then flow from the piston chamber 88 along the fluid outflow conduit 102 to the setting chamber 56. The check valve 104 will ensure that fluid flow only occurs into the setting chamber 56 and not out of it.

According to one example, the setting tool 12 can be used to set the packer device 10 within a wellbore having a hydrostatic annulus pressure of 20,000 psi at the desired depth of setting. The rupture disc 74 of the setting tool 12 in this example is designed to rupture at a pressure differential of 18,000 psi. Thus, 18,000 psi is the setting pressure. The initial pressure of the setting chamber 56 at surface (i.e., before the setting tool 12 starts down hole) in this example is 1 atmosphere (i.e, 14.223 psi) while the initial pressure within the collapsible chamber 46 is approximately 7000 psi. The setting module 34 in this example is designed to result in a fluid pressure level of approximately 5000 psi in both the collapsible chamber 46 and the setting chamber 56 at the setting depth. As the setting tool 12 is lowered toward the setting depth, the increasing hydrostatic pressure within the wellbore will increasingly transmit fluid pressure from the collapsible chamber 46 to the setting chamber 56.

In order to set the packer device 10 once it has been disposed at a desired position within the wellbore, an operator will apply an overpressure to the annulus 38 using a surface-base fluid pump or the like. In the particular example being described, an operator would apply 3000 psi of pressure to the annulus 38. This will provide a total setting pressure at the setting depth of 23,000 making the pressure differential across the rupture disc 74 of 18,000 psi. When the rupture disc 74 is broken, annulus fluid will enter the setting chamber 56 and increase fluid pressure within the setting chamber 56 to the setting pressure. The increased pressure within the setting chamber 56 acts upon the lock piston 58 and urges the lock piston 58 and lock ring 56 axially upward with respect to the inner mandrel 26, as illustrated by FIGS. 4 and 5. The lock ring 56 will move upwardly until the recess 70 is aligned with the locking dog 64, allowing the locking dog 64 to move radially outwardly into the recess 70. When this occurs, the inner mandrel 26 becomes unlocked from the upper housing section 40 permitting the upper housing section 40 to move upwardly collapsing the collapsible chamber 46. The movement of the upper housing section 40 with respect to the inner mandrel 26 sets the packer device 10. A body lock ring or similar mechanism may be used to ensure that the packer will not unset. However, the construction and operation of such devices is well known and will not be described herein.

The foregoing description is directed to particular embodiments of the present invention for the purpose of illustration and explanation. It will be apparent, however, to those skilled in the art that many modifications and changes to the embodiment set forth above are possible without departing from the scope and the spirit of the invention.

What is claimed is:

1. A setting tool for setting a well tool within a subterranean wellbore, the setting tool comprising:

an inner mandrel;

an outer housing radially surrounding the inner mandrel and being axially moveable with respect to the inner mandrel to set the well tool;

a pressure chamber defined radially between the inner mandrel and the outer housing;

a setting chamber defined radially between the inner mandrel and the outer housing, the outer housing being moved axially with respect to the inner mandrel as pressure within the setting chamber is increased; and a regulator that flows fluid from the pressure chamber to the setting chamber prior to actuating the setting tool to set the well tool as fluid pressure surrounding the setting tool is increased.

2. The setting tool of claim 1 wherein the regulator comprises a valve assembly that opens to flow fluid from the pressure chamber to the setting chamber, the valve assembly being opened in response to increased fluid pressure surrounding the setting tool.

3. The setting tool of claim 2 further comprising a piston member that receives fluid pressure from an annulus surrounding the setting tool and transmits that fluid pressure to the valve assembly.

4. The setting tool of claim 1 wherein the pressure chamber is a collapsible chamber that collapses as the outer housing moves axially with respect to the inner mandrel.

5. The setting tool of claim 1 further comprising a locking mechanism that releasably secures the inner mandrel to the outer housing, the locking mechanism releasing the inner mandrel from the outer housing when pressure is increased within the setting chamber.

6. The setting tool of claim 5 wherein the locking mechanism comprises:

a locking dog that resides within a groove in the inner mandrel; and a lock ring that prevents movement of the locking dog out of the groove, the lock ring being moved to allow the locking dog to move out of the groove when pressure is increased within the setting chamber.

7. The setting tool of claim 1 further comprising a frangible rupture member that closes off the setting chamber from the surrounding fluid pressure.

8. The setting tool of claim 1 wherein the well tool that is set by the setting tool is a packer device.

9. A setting tool for setting a well tool within a subterranean wellbore, the setting tool comprising:

an inner mandrel;

an outer housing radially surrounding the inner mandrel and being axially moveable with respect to the inner mandrel to set the well tool;

a collapsible chamber defined radially between the inner mandrel and the outer housing the collapsible chamber collapsing as the outer housing moves axially with respect to the inner mandrel;

a setting chamber defined radially between the inner mandrel and the outer housing, the outer housing being moved axially with respect to the inner mandrel as pressure within the setting chamber is increased; and a regulator that flows fluid from the collapsible chamber to the setting chamber prior to actuating the setting tool to set the well tool as fluid pressure surrounding the setting tool is increased.

10. The setting tool of claim 9 wherein the regulator comprises a valve assembly that opens to flow fluid from the collapsible chamber to the setting chamber, the valve assembly being opened in response to increased fluid pressure surrounding the setting tool.

11. The setting tool of claim 9 further comprising a piston member that receives fluid pressure from an annulus surrounding the setting tool and transmits that fluid pressure to the valve assembly.

12. The setting tool of claim 9 further comprising a locking mechanism that releasably secures the inner mandrel to the outer housing, the locking mechanism releasing the inner mandrel from the outer housing when pressure is increased within the setting chamber.

13. The setting tool of claim 12 wherein the locking mechanism comprises:

a locking dog that resides within a groove in the inner mandrel; and a lock ring that prevents movement of the locking dog out of the groove, the lock ring being moved to allow the locking dog to move out of the groove when pressure is increased within the setting chamber.

14. The setting tool of claim 9 further comprising a frangible rupture member that closes off the setting chamber from the surrounding fluid pressure.

15. The setting tool of claim 9 wherein the well tool that is set by the setting tool is a packer device.

16. A method of setting a well tool within a subterranean wellbore, the method comprising the steps of:

affixing a setting tool to the well tool, the setting tool being operable to set the well tool by axially moving an outer housing with respect to an inner mandrel, the setting tool having a pressure chamber and a setting chamber defined within and the setting tool being actuated to set the well tool when the setting chamber is pressurized to a setting pressure;

precharging the pressure chamber to a predetermined fluid pressure level that is greater than the fluid pressure level within the setting chamber;

transmitting pressurized fluid from the pressure chamber to the setting chamber as the setting tool is disposed at greater depths within the wellbore and prior to actuating the setting tool to set the well tool;

increasing fluid pressure within the setting chamber to the setting pressure to actuate the setting tool.

17. The method of claim 16 wherein the step of transmitting pressurized fluid from the pressure chamber to the setting chamber comprises opening a valve assembly that allows fluid flow from the pressure chamber to the setting chamber in response to increased hydrostatic pressure within the wellbore.

18. The method of claim 17 wherein the step of opening a valve assembly in response to increased hydrostatic pressure within the wellbore further comprises associating the valve assembly with a piston that is exposed to fluid pressure within a wellbore annulus surrounding the setting tool.

19. The method of claim 16 wherein the step of increasing fluid pressure within the setting chamber to the setting pressure further comprises rupturing a frangible rupture disc to allow the setting chamber to be flooded with fluid from a wellbore annulus surrounding the setting tool.

* * * * *